US006427477B2

(12) United States Patent
Incorvia et al.

(10) Patent No.: US 6,427,477 B2
(45) Date of Patent: Aug. 6, 2002

(54) SELF-RETAINING ADSORBENT UNIT

(75) Inventors: Samuel A. Incorvia, North Tonawanda; Peter R. Millen, Corfu, both of NY (US)

(73) Assignee: Multisorb Technologies, Inc., Buffalo, NY (US)

( * ) Notice: Subject to any disclaimer, the term of this patent is extended or adjusted under 35 U.S.C. 154(b) by 0 days.

(21) Appl. No.: 09/861,420

(22) Filed: May 18, 2001

Related U.S. Application Data

(63) Continuation of application No. 09/397,401, filed on Sep. 16, 1999, which is a continuation-in-part of application No. 09/346,199, filed on Jul. 1, 1999, now abandoned.

(51) Int. Cl.[7] ..... F25B 43/00
(52) U.S. Cl. ..... 62/474
(58) Field of Search ..... 62/474, 503; 55/515; 96/133, 147

(56) References Cited

U.S. PATENT DOCUMENTS

| | | | | |
|---|---|---|---|---|
| 4,116,649 A | | 9/1978 | Cullen et al. | |
| 4,401,447 A | | 8/1983 | Huber | |
| 4,405,347 A | | 9/1983 | Cullen et al. | |
| 4,457,843 A | | 7/1984 | Cullen et al. | |
| 4,464,261 A | | 8/1984 | Cullen et al. | |
| 4,619,673 A | | 10/1986 | Cullen et al. | |
| 4,911,739 A | * | 3/1990 | Cullen et al. | 96/147 |
| 4,994,185 A | | 2/1991 | Cullen et al. | |
| 5,036,972 A | | 8/1991 | Cullen et al. | |
| 5,635,525 A | * | 6/1997 | Riemenschneider | 62/474 |
| 5,636,525 A | | 6/1997 | Riemenschneider | |
| 5,693,124 A | | 12/1997 | Dobson et al. | |

* cited by examiner

*Primary Examiner*—William E. Tapolcai
(74) *Attorney, Agent, or Firm*—Joseph P. Gastel

(57) ABSTRACT

An adsorbent unit for a refrigerant accumulator having a housing with a bottom wall and a side wall and a U-shaped pipe with a return bend adjacent the bottom wall and with first and second pipe portions extending from the return bend along the side wall, and a filter body extending outwardly from the return bend, the adsorbent unit including a porous adsorbent container, adsorbent in the container, first and second end portions on the container, a first tab extending outwardly from the first end portion of the container, an elongated slot in the first tab mounting it on the first and second pipe portions, a second tab extending outwardly from the second end portion of the container, and an aperture on the second tab mounting it on the filter body. A double adsorbent container adsorbent unit having elongated slots on tabs at the outer ends thereof for mounting about the first and second pipe portions.

21 Claims, 12 Drawing Sheets

FIG. 6
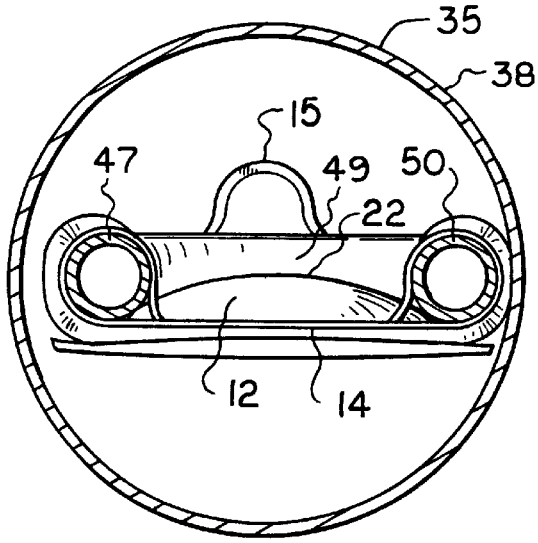
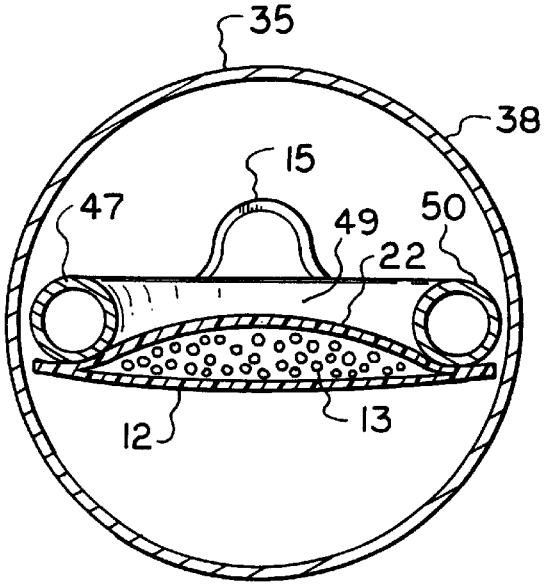
FIG. 7
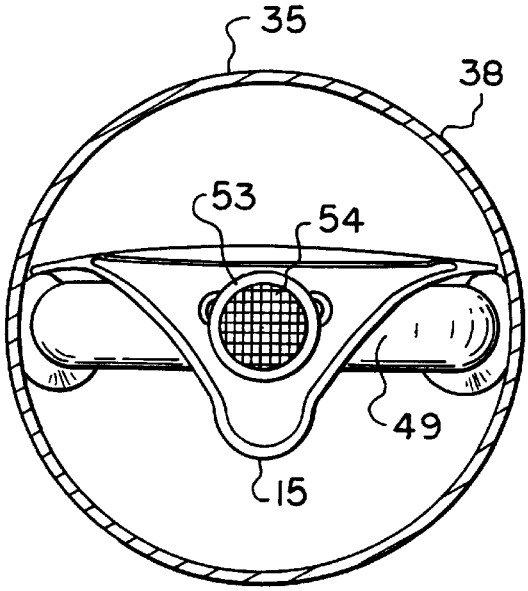
FIG. 8

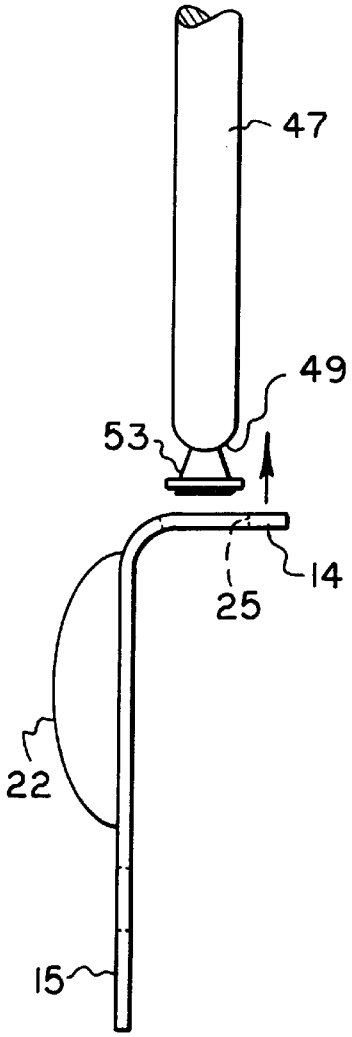
FIG. 11
FIG. 12
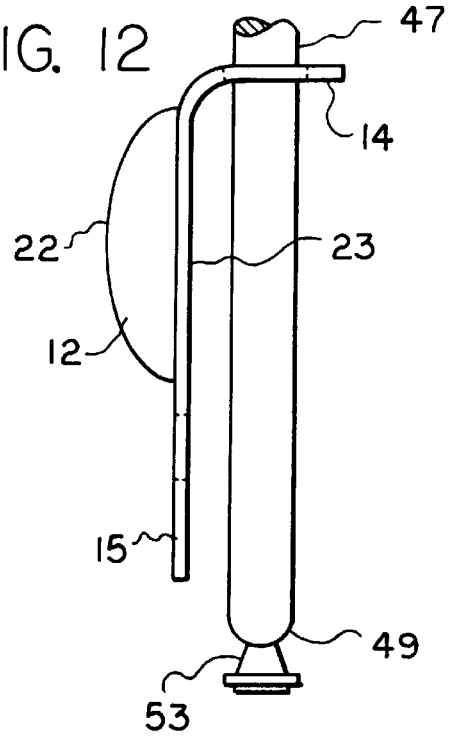
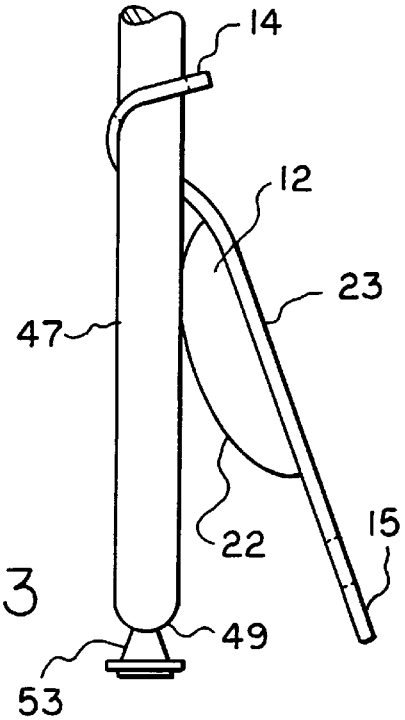
FIG. 13

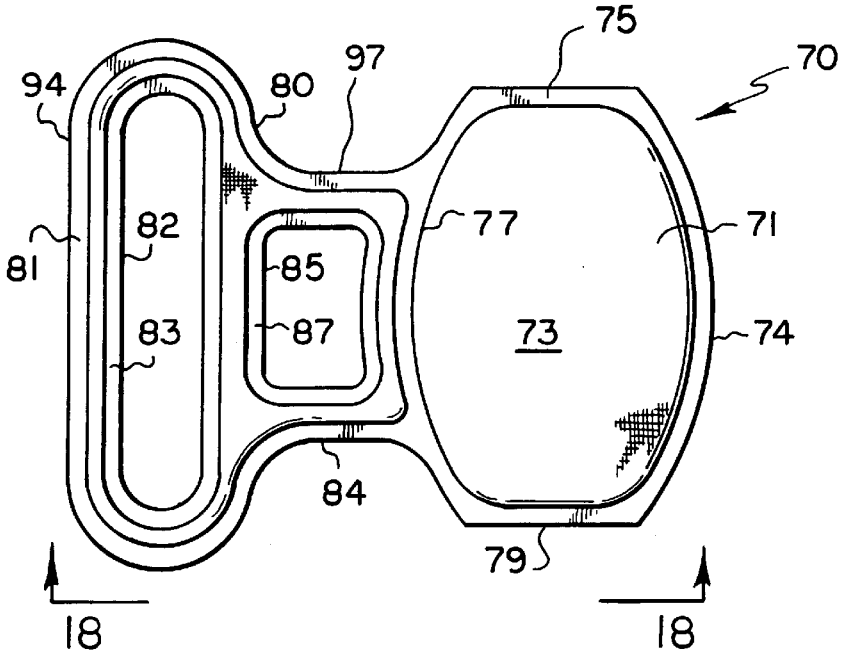
FIG. 17
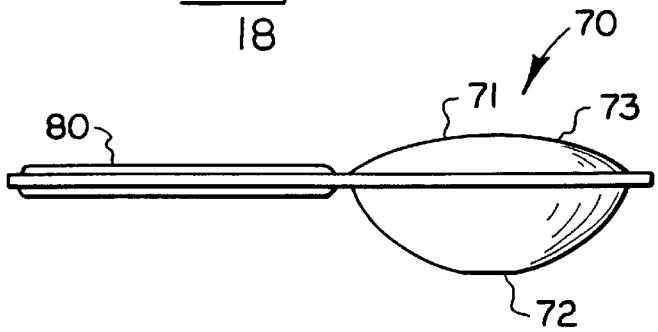
FIG. 18
FIG. 19
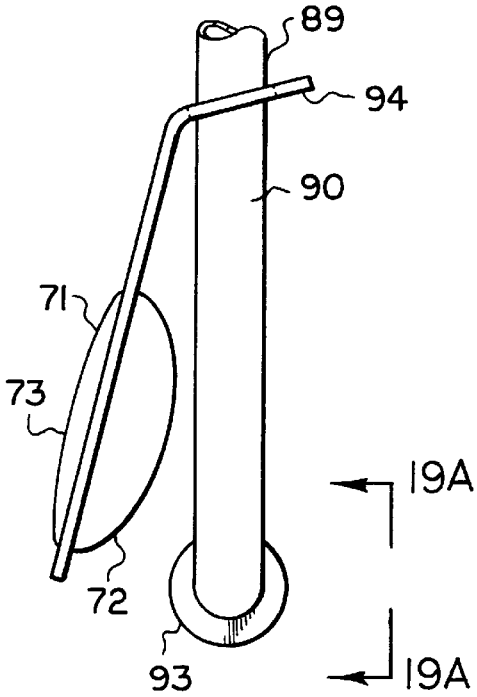
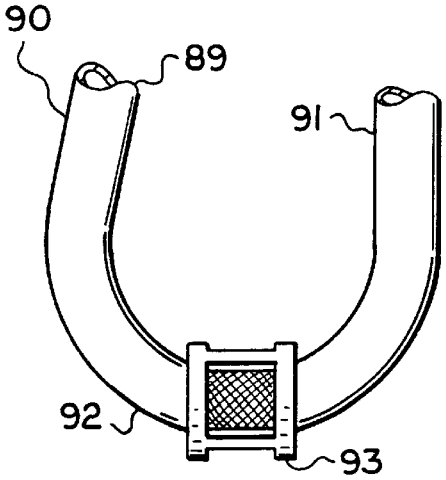
FIG. 19A

FIG. 32
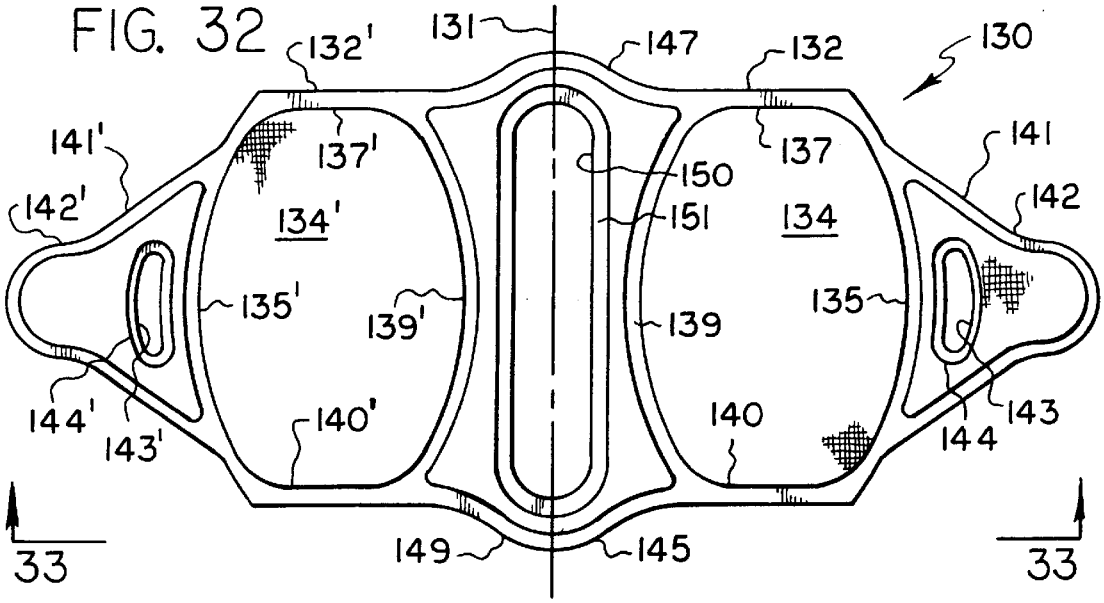
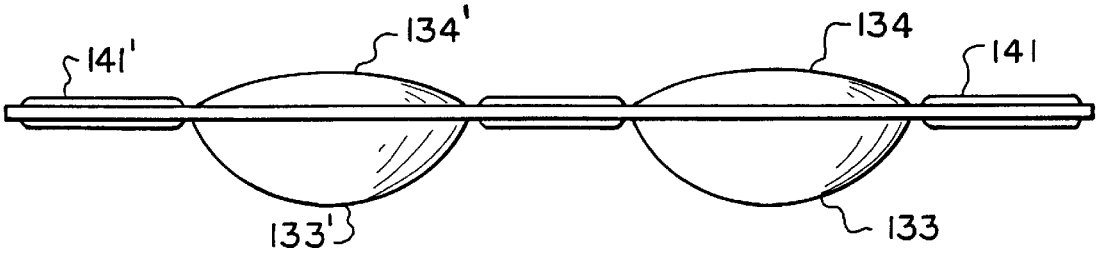
FIG. 33
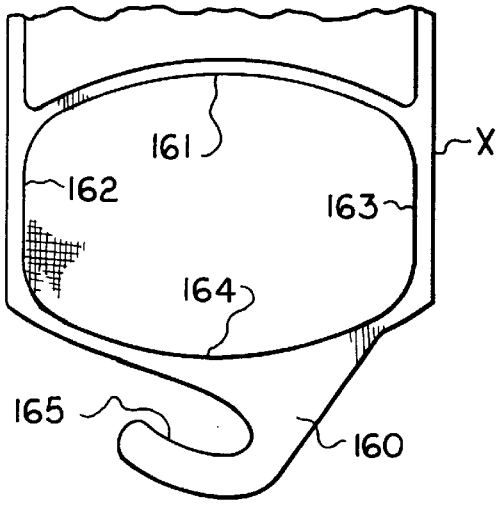
FIG. 34

SELF-RETAINING ADSORBENT UNIT

CROSS-REFERENCE TO RELATED APPLICATIONS

The present application is a continuation of Ser. No. 09/397,401, filed Sep. 16, 1999, which is a continuation-in-part of application Ser. No. 09/346,199, filed Jul. 1, 1999 now ABN.

STATEMENT REGARDING FEDERALLY SPONSORED RESEARCH OR DEVELOPMENT

Not Applicable

BACKGROUND OF THE INVENTION

The present invention relates to an improved adsorbent container for use in a refrigerant accumulator of an air conditioning system which contains a U-shaped return bend pipe.

By way of background, in the past when a single adsorbent unit was utilized in a refrigerant accumulator having a U-shaped return bend pipe, the bag itself had to be secured relative to the spaced pipes by means of an external tie or a clip which required extra parts and/or additional manipulative steps. Also, in the past, adsorbent units having two adsorbent containers were used on the U-bends of refrigerant accumulators. However, the outer ends of the two containers were not positively tied to the spaced pipes of the U-bend. It is with overcoming the foregoing deficiencies of certain prior adsorbent units that the present invention is concerned.

BRIEF SUMMARY OF THE INVENTION

It is one object of the present invention to provide an improved single container adsorbent unit for a U-bend pipe of a refrigerant accumulator in which the mounting structure is an integral portion of the adsorbent unit itself.

It is another object of the present invention to provide an improved method for mounting a single container type of adsorbent unit onto the U-shaped pipe of a refrigerant accumulator.

A further object of the present invention is to provide an improved double container adsorbent unit having structure which permits both the outer ends of the double unit and the central portion thereof to be positively tied to an U-bend of a refrigerant accumulator. Other objects and attendant advantages of the present invention will readily be perceived hereafter.

The present invention relates to an adsorbent unit comprising a porous adsorbent container having a width, adsorbent in said container, a tab extending outwardly from said container, and an elongated slot in said tab extending in the direction of said width of said container and said slot having a length which approximates said width of said container.

The present invention also relates to an adsorbent unit comprising an adsorbent container, adsorbent in said container, first and second end portions on said container, a first tab on said first end portion, an aperture in said first tab, and a second elongated tab on said second end portion, said second elongated tab having a length which is a longer than the length of said container.

The present invention also relates to an adsorbent unit for mounting relative to a U-bend pipe of a refrigerant accumulator having spaced pipes and a return bend comprising a porous container, adsorbent in said container, first and second end portions on said container, first mounting means on said first end portion for placement about said spaced pipes with said container located between said first mounting means and said return bend, and second mounting means at said second end of said container for mounting relative to said return bend.

The present invention also relates to a refrigerant accumulator having a housing with a bottom wall and a side wall and a U-shaped pipe with a return bend adjacent said bottom wall and with first and second pipe portions extending from said return bend along said side wall, and a filter body extending outwardly from said return bend, the improvement of an adsorbent unit comprising a porous adsorbent container, adsorbent in said container, first and second end portions on said container, first means on said first end portion for mounting said adsorbent container relative to said first and second pipe portions, and second means on said second end portion for mounting said adsorbent container relative to said return bend.

The present invention also relates to a method of securing a container of adsorbent to a U-tube having spaced pipes connected by a return bend comprising the steps of providing first and second tabs on said container of adsorbent, looping said first tab about said spaced legs, and connecting said second tab relative to said return bend.

The present invention also relates to an adsorbent unit comprising a porous container having a width, adsorbent in said container, a tab extending outwardly from said container, an elongated slot in said tab extending in the direction of said width of said container, said elongated slot having a length which approximates the width of said container, and an aperture in said tab located between said elongated slot and said container.

The present invention also relates to an adsorbent unit comprising a porous adsorbent container having a width, adsorbent in said container, a tab extending outwardly from said container, an elongated slot in said tab extending in the direction of said width of said container and said tab having a length which approximates said width of said container, and means on said tab for securing said tab to the return bend of an U-shaped pipe.

The present invention also relates to an adsorbent unit comprising first and second porous containers, a central joining-portion joining first ends of said first and second containers in end-to-end relationship, first and second tabs on second ends of said first and second containers, respectively, first and second elongated slots in said first and second tabs, respectively, extending in the direction of the widths of said first and second containers, and said first and second slots having lengths which approximate the widths of said first and second containers.

The present invention also relates to an adsorbent unit comprising first and second porous containers having widths, adsorbent in said first and second containers, a central joining-portion joining ends of said first and second containers in end-to-end relationship, and an elongated slot in said central joining portion extending in the direction of said widths of said first and second containers and having a length which approximates the widths of said first and second containers.

The present invention also relates to an adsorbent unit comprising a porous adsorbent container, adsorbent in said container, and loop means secured to said container for looping about at least one pipe of an U-shaped pipe.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 6 is a cross sectional view taken substantially along line 6—6 of FIG. 5 and showing primarily the tab with the elongated slot looped about the spaced pipes of the U-bend pipe;

FIG. 7 is a cross sectional view taken substantially along line 7—7 of FIG. 5 and showing the relationship between the container of the adsorbent unit and the spaced pipes of the U-bend pipe;

FIG. 8 is a view taken substantially in the direction of arrows 8—8 of FIG. 5 and showing the tab at the outer end of the adsorbent container mounted on the body of the filter housing on the return bend of the U-bend pipe;

FIG. 11 is a view taken substantially in the direction of arrows 11—11 of FIG. 10;

FIG. 12 is a schematic view showing the tab with the elongated slot looped about the spaced pipes of the U-bend pipe;

FIG. 13 is a schematic view showing the adsorbent container threaded through the space between the spaced pipes of the U-bend pipe;

FIG. 17 is a plan view of another embodiment of an adsorbent unit having a single adsorbent container which can be mounted on a U-bend pipe with a tab portion looped about the spaced pipes thereof;

FIG. 18 is a side elevational view taken substantially in the direction of arrows 18—18 of FIG. 17;

FIG. 19 is a fragmentary side elevational view showing the initial stage of mounting the adsorbent unit of FIG. 17 onto a U-bend pipe;

FIG. 19A is a view taken substantially in the direction of arrows 19A—19A and showing the filter structure on the return bend of the U-bend pipe;

FIG. 32 is a plan view of another embodiment of a double adsorbent container type of adsorbent unit which has structure for positively securing both the outer ends thereof and the central portion on a U-bend pipe;

FIG. 33 is a side elevational view taken substantially in the direction of arrows 33—33 of FIG. 32; and FIG. 34 is a fragmentary plan view of an adsorbent container having a hook-type of end for securing it relative to the filter housing of a U-bend pipe.

DETAILED DESCRIPTION OF THE INVENTION

Figure 1:
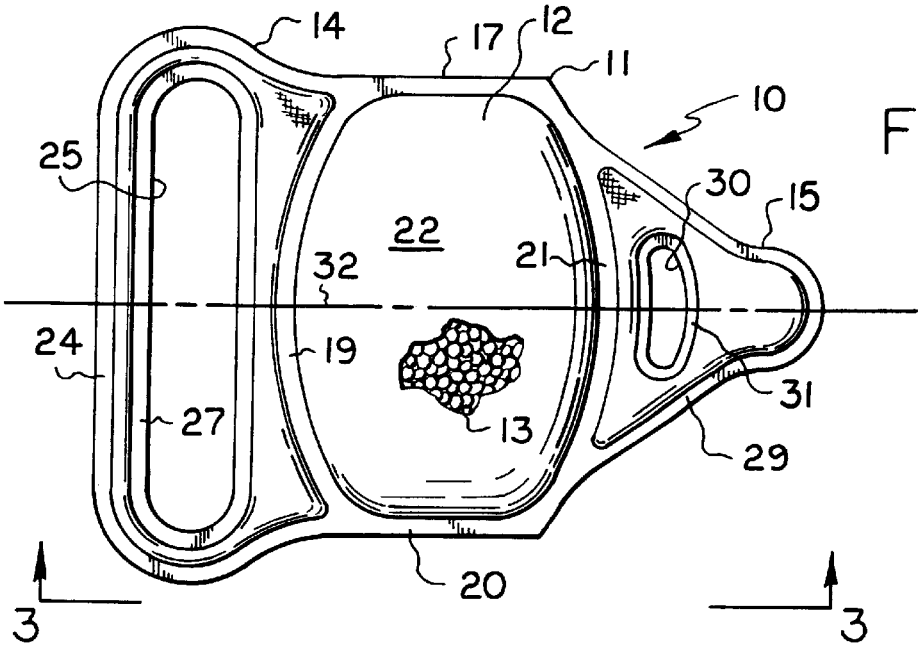
FIG. 1 is a partially broken away plan view of one embodiment of the adsorbent unit of the present invention showing the pronounced convex surface portion thereof.

The adsorbent unit 10 of the present invention includes a casing 11 formed of porous material, in this instance, heat-fusible felted polyester, but it may be fabricated of any other suitable material. Casing 11 is formed from two sides of felted polyester which are bonded to each other by fused seams, and it comprises a container 12 containing adsorbent 13 with the container having apertured tabs 14 and 15 extending outwardly from the opposite end portions thereof, as described in detail hereafter. The preferred adsorbent is molecular sieve but any other suitable adsorbent may be used.

Container 12 is defined by fused seams 17, 19, 20 and 21. Container 12 has a pronounced convex surface 22 and a substantially planar surface 23. However, surface 23 may be convex. Tab 14 includes an outer fused seam 24 which merges into seams 17 and 20, and tab 14 is defined by fused seams 24 and 19. Tab 14 includes an elongated slot 25 which is defined by fused seam 27. Tab 15 is outlined by fused seam 29 and a portion of fused seam 21. An aperture 30 in tab 15 is outlined by fused seam 31.

The adsorbent unit 10 is symmetrical about central axis 32, but it need not be. Additionally, elongated slot 25 approximates the width of container 12 across fused seams 17 and 20, and the length of slot 25 extends in substantially the same direction as the width across seams 17 and 20. The foregoing approximate relationship means that the slot 25 has a length which is generally about the width of the container 12 so that the return bend end of a U-bend pipe can be inserted through it, as will become apparent hereafter. Thus, the length of slot 25 can be slightly smaller or slightly larger than the width of the adsorbent container 12.

The adsorbent unit 10 is intended to be mounted in a prior art accumulator-type of receiver 33 (FIGS. 4 and 5) which includes an upper cylindrical housing portion 34 having a side wall 36 and a lower cylindrical housing portion 35 having a side wall 38 and having a flange 37 which receives the lower edge portion of upper portion 34 with an interference fit, and a joint is thereafter hermetically welded at 39. Insofar as pertinent here, the accumulator 33 includes a U-bend pipe 40 having a refrigerant inlet end 41 which receives a mix of gaseous and liquid refrigerant and conducts it through pipe 42 having an open end 43 proximate concave surface 44 such that the refrigerant impinges thereon and enters the accumulator. The upper end 45 of U-shape pipe 40 is open and it receives gaseous refrigerant which passes through pipe 47, return bend 49, pipe 50, and pipe 51 to outlet 52 which leads to the compressor, as is well known in the art. As noted above, the gaseous refrigerant passes through U-shaped tube 40 because it rises to the top while the liquid refrigerant from the evaporator drops to the bottom of the accumulator. A lubricant inlet (not shown) is located at the underside of the return bend 49. A filter housing 53 having a filter 54 thereon is in communication with the lubricant inlet in the return bend 49 such that lubricant which accumulates in depression 55 of bottom wall 56 is induced into the return bend and conveyed with the gaseous refrigerant to the compressor, as is well known in the art. As can be seen from FIG. 5, the U-bend 40 includes two spaced pipes 47 and 50 which are connected by U-bend 49. In the present instance, pipe 50 is substantially vertical and pipe 47 is inclined. The U-bend 40 is sometimes referred to as a J-bend.

In FIGS. 5–9, adsorbent unit 10 is shown in its installed position. In this respect, tab 14 is looped about the outer sides of pipes 47 and 50 which face away from each other, and the pipes 47 and 50 thus pass through elongated slot 25 in tab 14. The convex side 22 of adsorbent container 12 bears against pipes 47 and 50, and the central portion of convex side 22 protrudes into the space between pipes 47 and 50. Tab 15 is mounted on filter housing 53 which protrudes through aperture 30.

Figure 14:
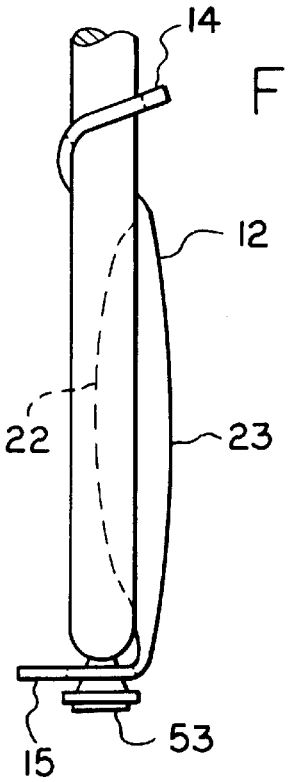
FIG. 14 is a schematic view showing the apertured tab mounted on the filter housing.

The manner in which adsorbent unit 10 is installed is set forth in FIGS. 10–14. The first step is to thread the return bend 49 and spaced pipes 47 and 50 through elongated slot 25 of tab 14 as depicted in the progression shown in FIGS. 10–12. Thereafter, as shown in FIG. 13, the container 12 is passed through the space between pipes 47 and 50 below tab 14 until container side 22 faces pipes 47 and 50. Thereafter, as shown in FIG. 14, the filter housing 53 is threaded through aperture 30 of tab 15 to complete the mounting of adsorbent unit 10 on the U-bend pipe 40.

It can thus be seen that the tab 14 secures one end of the adsorbent container 12 relative to the spaced pipes 47 and 50, and tab 15 secures the other end of adsorbent container 12 relative to return bend 49 and holds the container 12 against moving upwardly in the accumulator. Additionally, it is to be observed that there are no external ties required to hold the adsorbent container 12 in position, and, further, the installation is extremely simple by following the above-described steps enumerated relative to FIGS. 10–14 wherein the return bend 49 and the spaced pipes 47 and 50 are threaded through elongated aperture 25 of tab 14, and then the adsorbent container 12 is passed through the space between pipes 47 and 50 below tab 14, and thereafter tab 15 is mounted on filter housing 53. In the final installed position, the convex side 22 of adsorbent container 12 lies in contiguous relationship to return bend 49 and spaced pipes 47 and 50. If desired, the adsorbent unit 10 may be installed with adsorbent container side 23 bearing against spaced pipes 47 and 50. However, this does not have the advantage shown in FIG. 7 wherein the convex configuration of side 22 helps to maintain the adsorbent unit in position against sidewise movement relative to pipes 47 and 50. Also, the adsorbent unit may be mounted by slipping the U-bend through the elongated slot 25 and thereafter mounting tab 14 on the filter housing without passing the adsorbent container 12 through the space between pipes 47 and 50 as described above.

Figure 2:
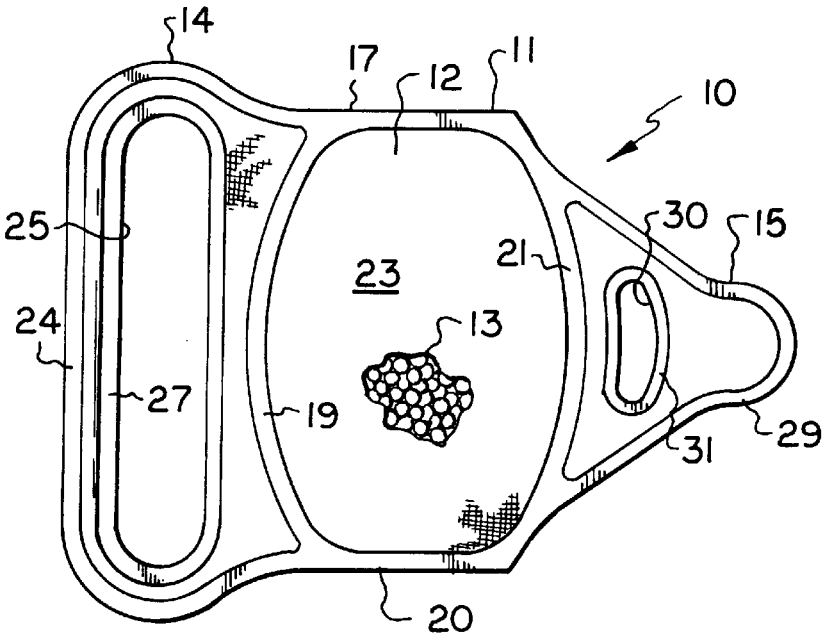
FIG. 2 is a partially broken away plan view of the adsorbent unit showing the substantially planar surface thereof.
Figure 3:
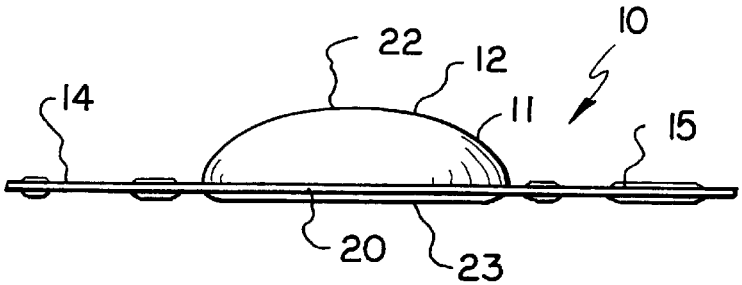
FIG. 3 is a side elevational view taken substantially in the direction of arrows 3—3 of FIG. 1.
Figure 15:
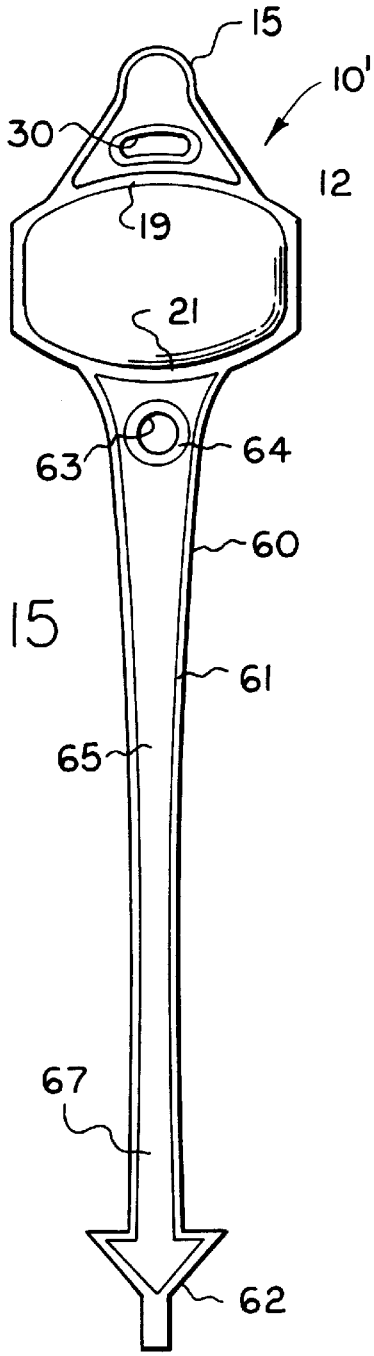
FIG. 15 is a plan view of another type of adsorbent container which can be mounted on a U-bend pipe with a tab portion looped about the spaced pipes thereof.
Figure 16:
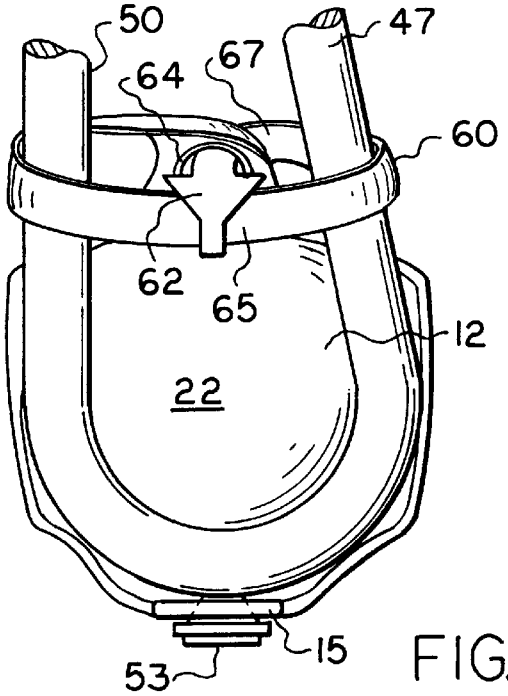
FIG. 16 is a fragmentary view showing the adsorbent unit of FIG. 15 mounted on a U-bend pipe.

In FIGS. 15 and 16 another type of self-retaining adsorbent unit 10' is shown wherein the adsorbent container portion 12 may be identical in all respects to adsorbent container 12 of FIGS. 1–3. Additionally, the tab 15 may be identical in all respects to tab 15 of FIGS. 1–3. The only difference between the adsorbent unit 10 of FIGS. 1–3 and the adsorbent unit 10' of FIGS. 15 and 16 is that an elongated tab 60 replaces tab 14 of FIGS. 1–3. The elongated tab has a length which is longer than the length of said container between seams 19 and 21. Elongated tab 60 includes a fused seam 61 which extends along the outer edges thereof and comprises the periphery of barb 62 at the outer end of tab 60. Additionally, an aperture 63, which is bordered by fused seam 64, is located in the portion of tab 60 adjacent adsorbent container 12.

The adsorbent unit 10' is mounted in the following manner. Tab 15 is mounted on filter housing 53 by inserting housing 53 through aperture 30 of tab 15. Thereafter, the side 22 of adsorbent container 12 is placed in contiguous relationship to pipes 47 and 50. Then the end of tab 60 adjacent container 12 is passed around the back of pipe 50 and the central portion 65 of tab 60 is looped around the front of pipes 50 and 47, and thereafter the end portion 67 of tab 60 is passed around the rear of pipe 47 and the barb 62 is passed through aperture 63 to retain tab 60 in looped relationship to pipes 47 and 50. In the foregoing position tab 60 is looped about the outer sides of pipes 47 and 50 which face away from each other.

While not shown in the drawing, it will be under-stood that with the embodiment of FIGS. 15 and 16, two adsorbent units 10' can be mounted on a U-bend pipe if desired to obtain more adsorbent than contained in a single unit 10'. This can be achieved by mounting them sequentially on opposite sides of the U-bend pipe with their convex sides 22 facing each other. Preferably, however, one of the adsorbent containers 12 should be longer than the other so that tabs 60 are vertically spaced on pipes 47 and 50, although this is not necessary because of the flexibility of tabs 60.

Also while not shown in the drawing, two adsorbent units 10 of FIGS. 1–3 can also be mounted on the U-bend pipe 40 in the following manner. Two adsorbent units 10 are held with their sides 22 facing each other and with their tabs 14 superimposed so that slots 25 are aligned. Then the U-bend pipe 40 is threaded through both slots 25 until both tabs 14 lie along pipes 47 and 50 with both containers 12 located to one side of pipes 47 and 50. Thereafter, one container 12 is threaded through the space between the two pipes 47 and 50 so that now the two containers are on opposite sides of pipes 47 and 50 with their sides 22 facing each other. Then the tab 15 of each adsorbent unit 10 is mounted on the filter housing 53 so that they overlap each other.

In FIGS. 17 and 18 another embodiment of a single container type of adsorbent unit 70 is shown which includes a container 71 having a pronounced convex side 72 and a less pronounced convex side 73. Container 71 is fabricated of two sides of felted polyester which are bonded to each other by fused seams 74, 75, 77 and 79. A tab 80 is formed as a continuation of container 71 and it is outlined by fused seam 81, the ends of which merge into fused seam 77. Tab 80 includes an elongated slot 82 which is defined by fused seam 83. Tab 80 includes an intermediate portion 84 which has an aperture in the form of a slot 85 therein which is defined by fused seam 87. Adsorbent unit 70 contains molecular sieve, but it may contain any other type of suitable adsorbent. Slot 82 is dimensioned substantially in the same manner as slot 25 of FIGS. 1 and 2.

Figure 4:
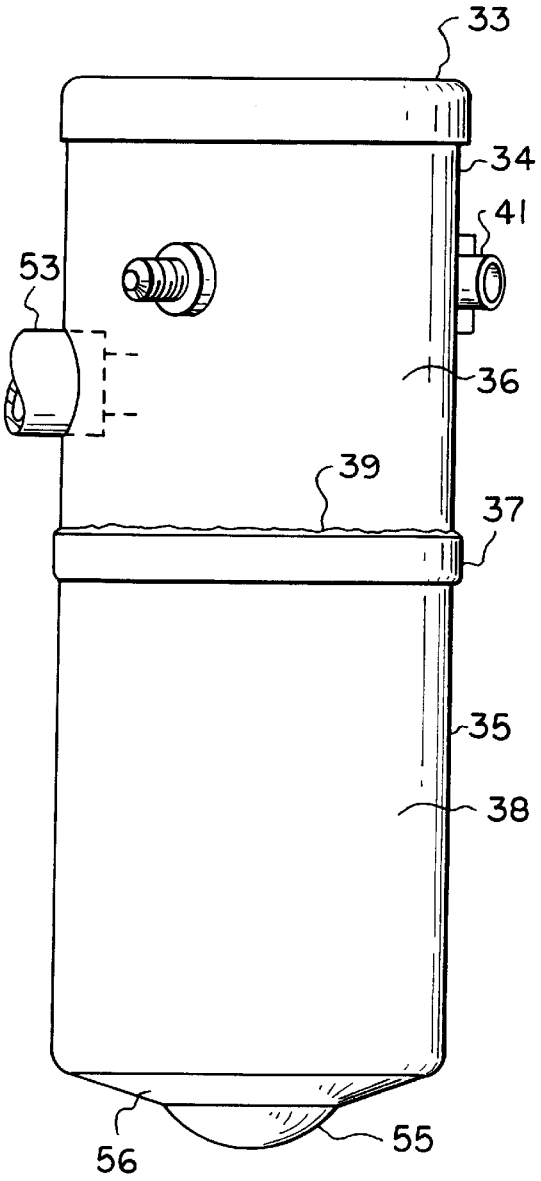
FIG. 4 is a side elevational view of an accumulator type of receiver in which the adsorbent unit is mounted.
Figure 5:
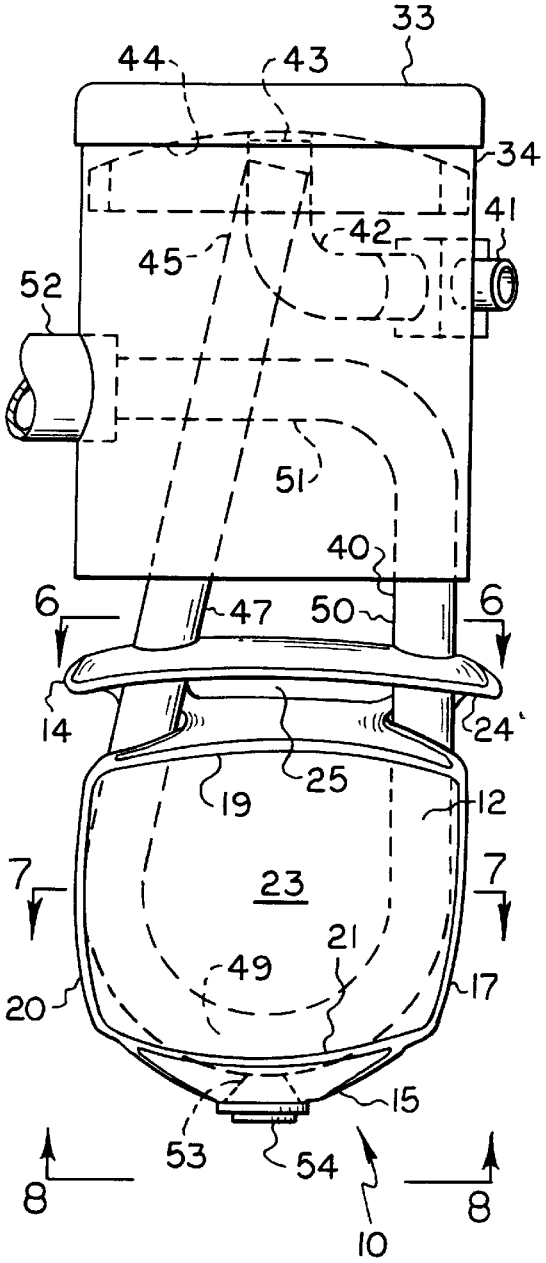
FIG. 5 is a side elevational view of the accumulator of FIG. 4 with the bottom portion removed and the adsorbent unit of the present invention mounted relative to the U-bend pipe therein.
Figure 9:
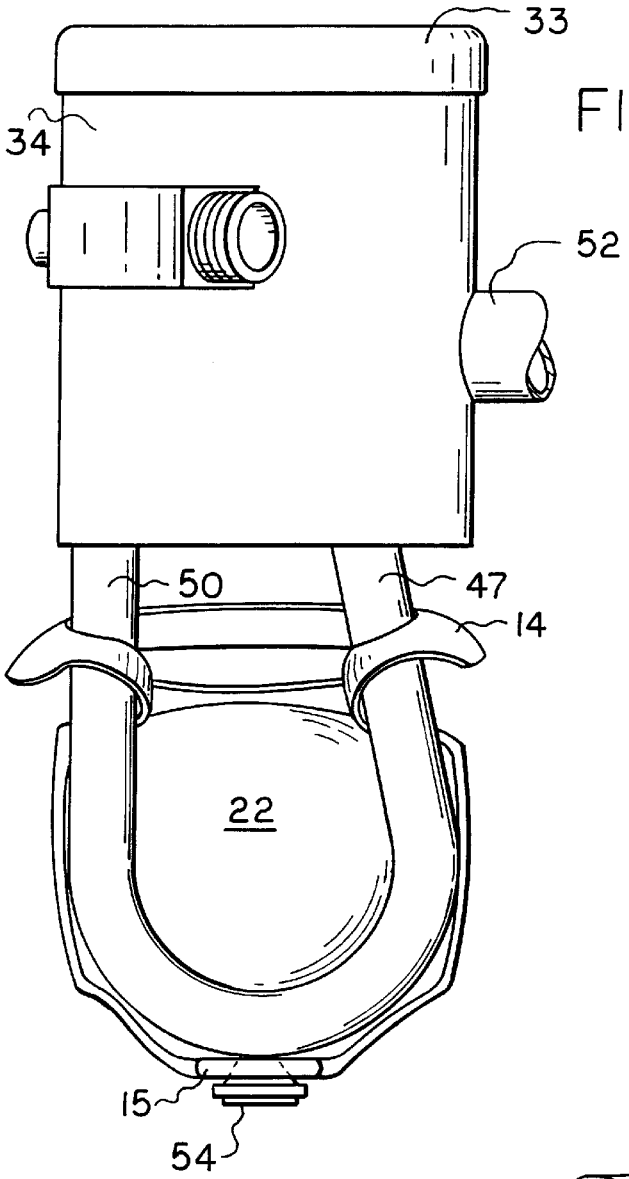
FIG. 9 is a view similar to FIG. 5 but showing the parts oriented 180° from the orientation in FIG. 5.
Figure 10:
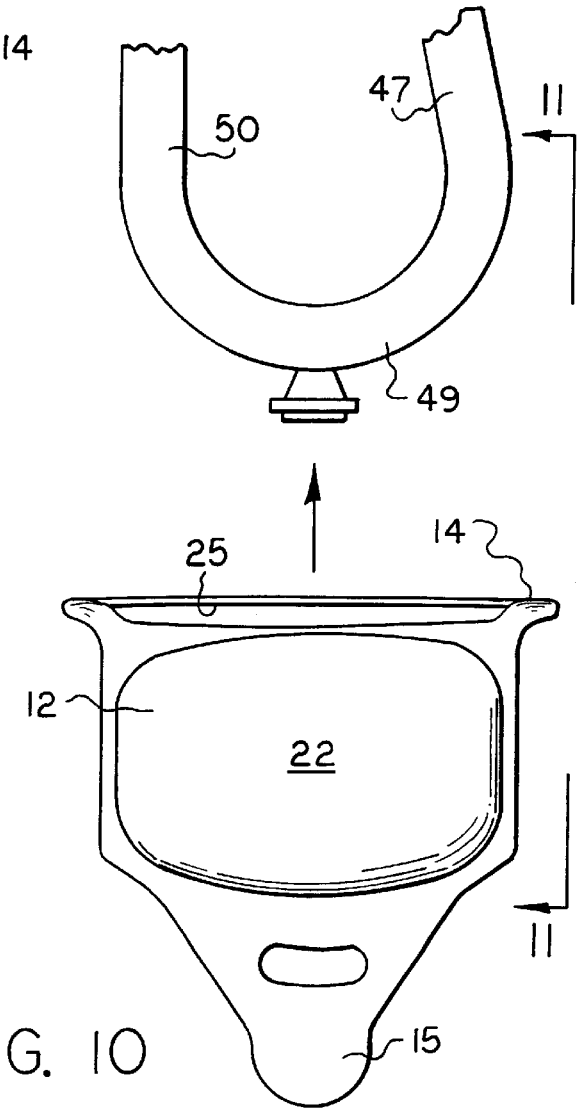
FIG. 10 is a schematic view showing the first step of mounting the tab with the elongated slot onto the end of the U-bend pipe.
Figure 20:
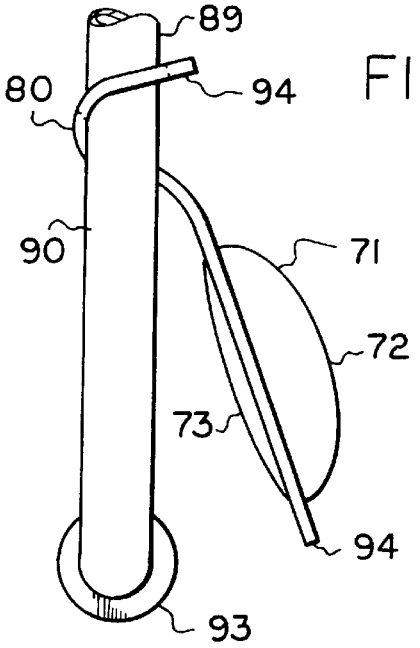
FIG. 20 is a view showing the second step in mounting the adsorbent unit of FIG. 17 onto the U-bend pipe.
Figure 21:
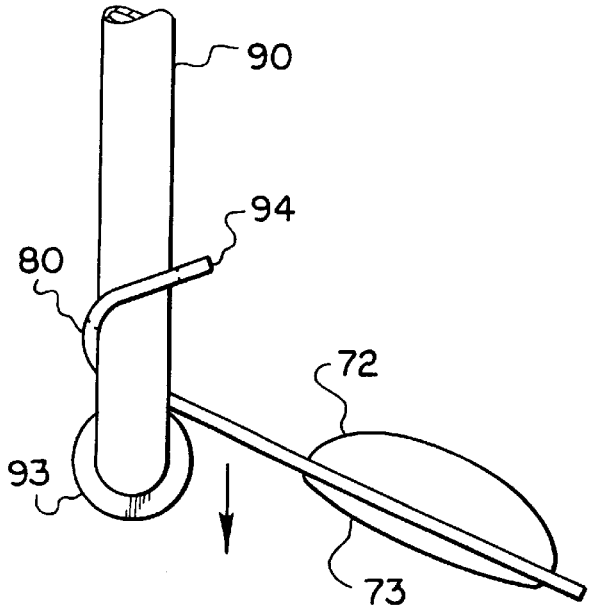
FIG. 21 is a fragmentary side elevational view showing the third step of mounting the adsorbent unit of FIG. 17 on a U-bend pipe.
Figure 22:
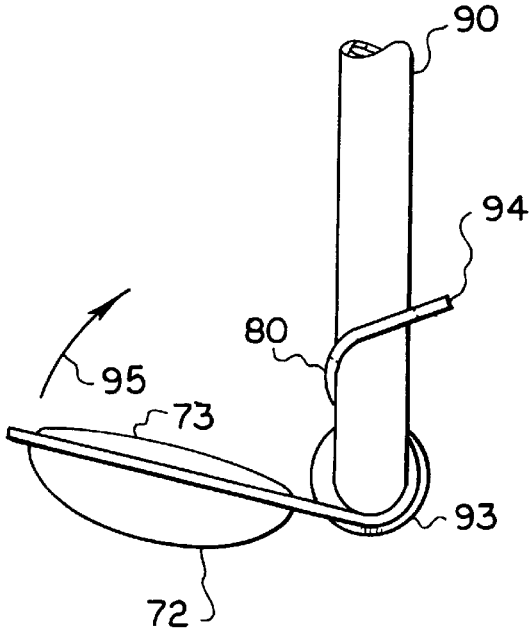
FIG. 22 is a fragmentary side elevational view showing the third step of mounting the adsorbent unit of FIG. 17 onto the U-bend pipe.
Figure 23:
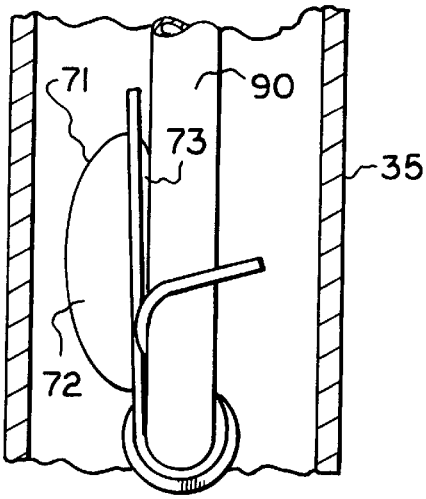
FIG. 23 is a fragmentary side elevational view, partially in cross section, showing the last step of mounting the adsorbent unit of FIG. 17 onto a U-bend pipe and also showing the accumulator in cross section.

Adsorbent unit 70 is mounted on U-bend pipe 89 having spaced legs 90 and 91 and return bend 92 having a cylindrical filter housing 93 thereon, the latter being well known in the art. The first step in mounting adsorbent unit 70 onto U-bend pipe 89 is to thread the U-bend through elongated slot 82 in the outer end 94 of tab 80 and move the end 94 of tab 84 up to a position where it is looped about spaced legs 90 and 91, as shown in FIG. 19. The second step is to thread the adsorbent container 71 through the space between legs 90 and 91 to the position shown in FIG. 20. Thereafter, the outer end 94 of tab 80 is pulled downwardly to the position of FIG. 21. The next step is shown in FIG. 22 wherein the adsorbent unit 70 is moved in the direction of arrow 95 so that the filter housing 93 is received in substantially rectangular aperture 85 in the central portion 97 of tab 80, as shown in FIG. 22. The final step is shown in FIG. 23 wherein the adsorbent container 71 is moved into a position so that its less convex side 73 lies along legs 90 and 91. Thereafter, the U-bend with the adsorbent unit is installed into the lower cylindrical housing portion 35 of a receiver-type of accumulator, such as shown in FIGS. 4 and 5. It will be appreciated that adsorbent unit 70 can be used with an U-shaped pipe 40 of FIG. 5 having a filter housing 53 by merely changing the shape of the aperture 85, if necessary to a more circular shape.

Figure 24:
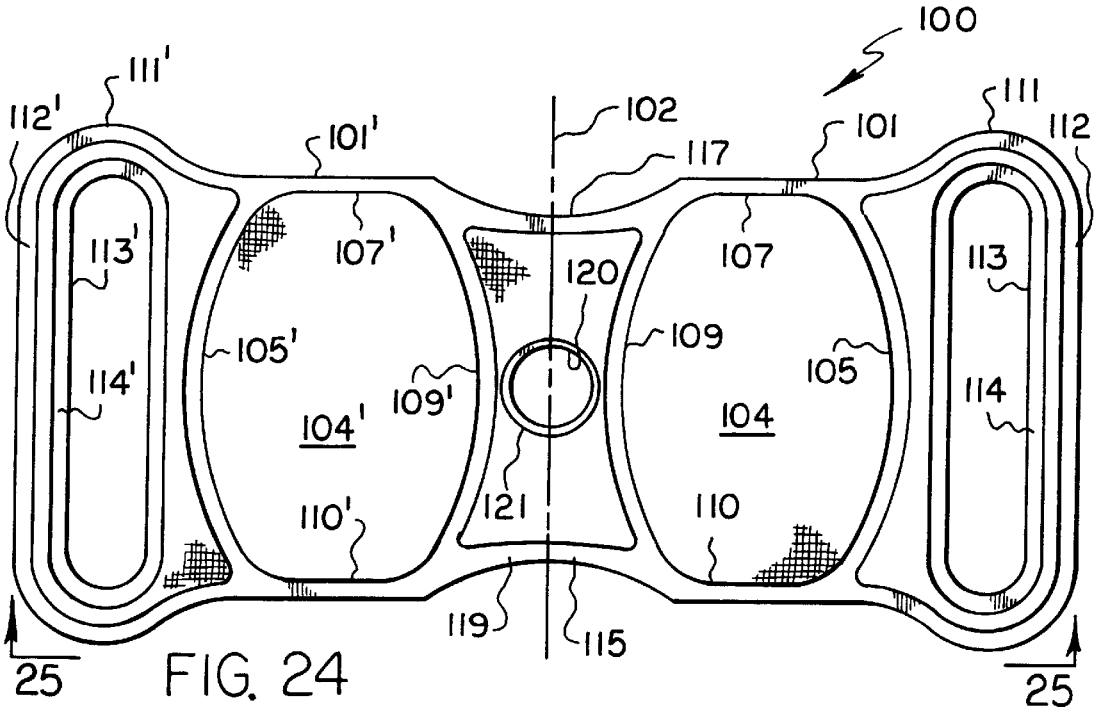
FIG. 24 is a fragmentary plan view of an adsorbent unit having two adsorbent containers and loops at the outer ends for positively securing the outer ends relative to a U-bend pipe.
Figure 25:
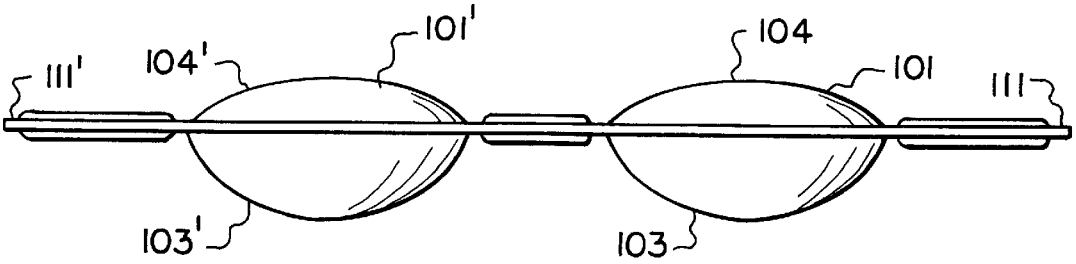
FIG. 25 is a side elevational view of the adsorbent unit of FIG. 24 taken substantially in the direction of arrows 25—25 of FIG. 24.

In FIGS. 24 and 25 an adsorbent unit 100 is shown having spaced adsorbent containers 101 and 101'. It is to be noted that adsorbent unit 100 is symmetrical about vertical centerline 102, and therefore only one side will be described with unprimed numerals in the interest of brevity and primed numerals will be applied to corresponding mirror image counterparts without an accompanying description. The adsorbent unit 100 is fabricated of two sheets of porous polyester material which are formed as shown and secured to each other by fused seams. Adsorbent container 101 includes a pronounced convex side 103 and a less pronounced convex side 104. Container 104 is defined by fused seams 105, 107, 109 and 110. A tab 111 extends outwardly from container 104, and its outer edge is defined by fused seam 112 which merges into fused seams 107 and 110. An elongated slot 113 is formed in tab 112 and it is defined by fused fuse 114. A central joining portion 115 joins containers 101 and 101' and it is defined by fused seams 117, 119, 109 and 109'. Central portion 115 has an aperture 120 which is defined by fused seam 121. Central portion 115 is essentially a tab because it attaches the containers 101 and 101' relative to the U-shaped pipe by having the filter 53 pass through aperture 120.

Figure 26:
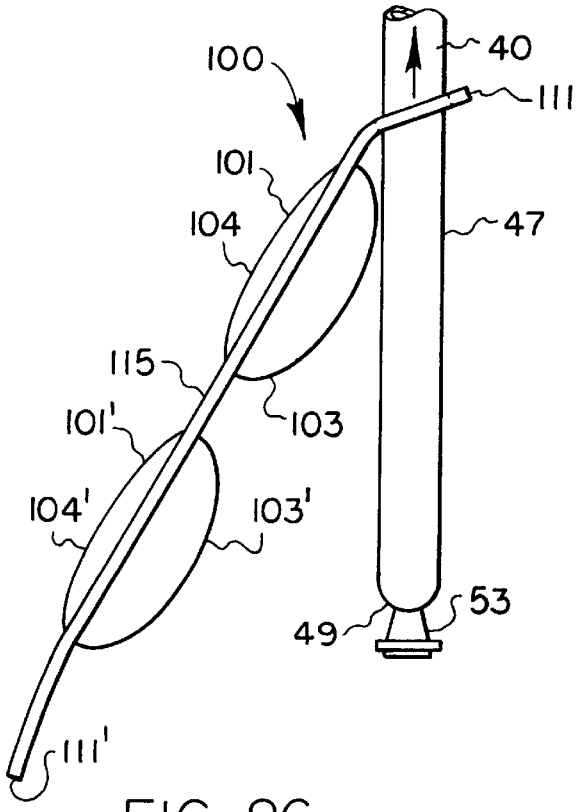
FIG. 26 is a side elevational view of the first step in mounting the adsorbent unit of FIG. 24 onto a U-bend pipe.
Figure 27:
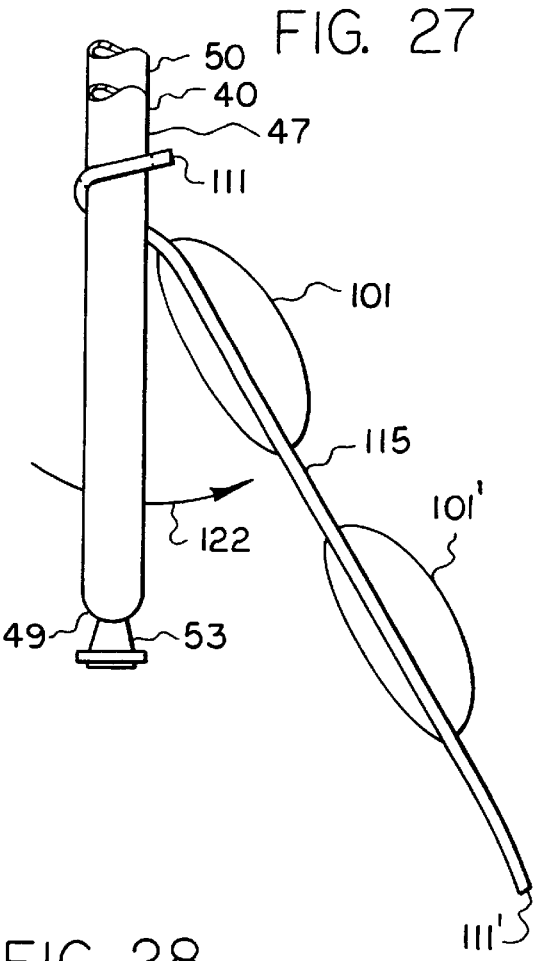
FIG. 27 is a fragmentary side elevational view of the second step in mounting the adsorbent unit of FIG. 24 onto a U-bend pipe.
Figure 28:
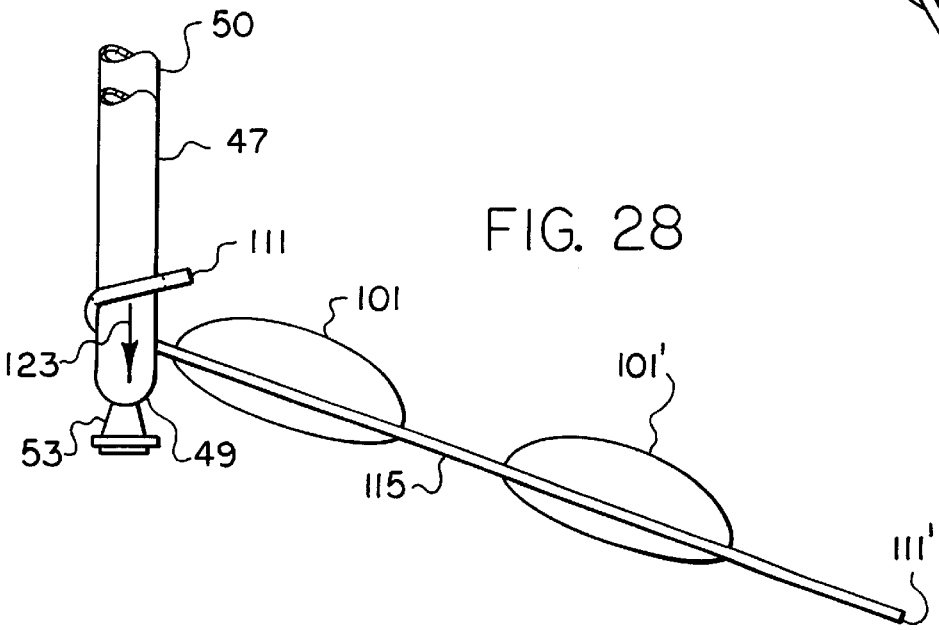
FIG. 28 is a fragmentary side elevational view of the third step of mounting the adsorbent unit of FIG. 24 onto a U-bend pipe.
Figure 29:
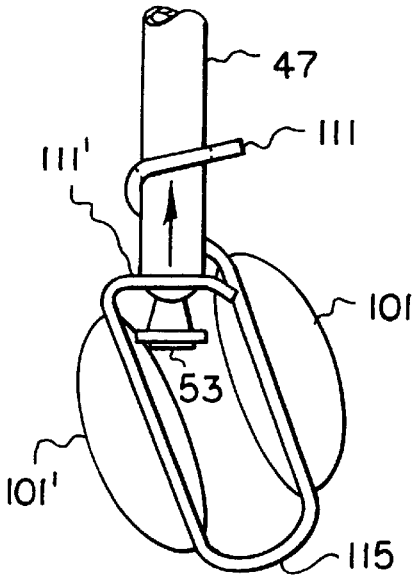
FIG. 29 is a fragmentary side elevational view of the fourth step in mounting the adsorbent unit of FIG. 24 onto a U-bend pipe.
Figure 30:
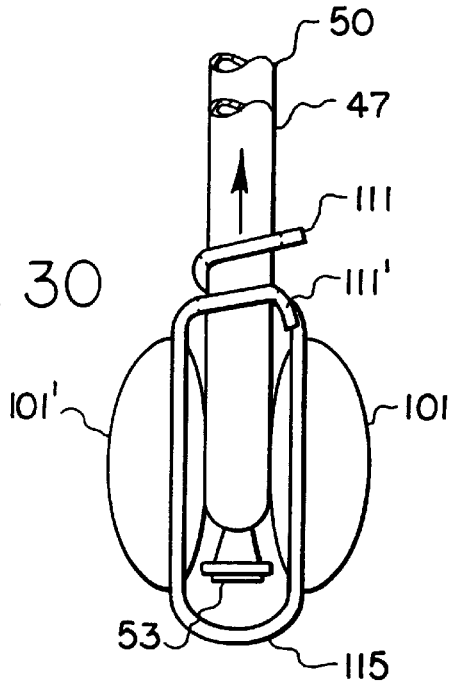
FIG. 30 is a fragmentary side elevational view of the fourth step in mounting the adsorbent unit of FIG. 24 onto a U-bend pipe.
Figure 31:
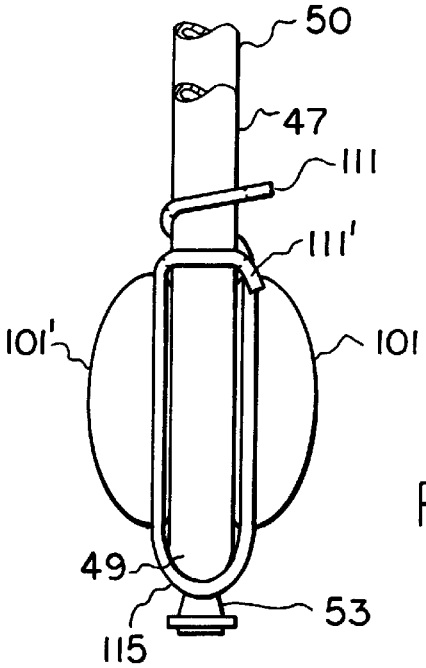
FIG. 31 is a fragmentary side elevational view showing the fifth step of mounting the adsorbent unit of FIG. 24 onto a U-bend pipe.

The adsorbent unit 100 is mounted on a U-bend pipe, such as 40 of FIG. 5, having a filter housing 53 on the return bend 49 thereof. U-bend pipe 47 also has spaced pipes 47 and 50 as depicted in FIG. 5. The first step in mounting the adsorbent unit 100 onto U-bend pipe 40 is to insert the U-bend pipe 40 through elongated slot 113 of tab 111 and move it up to a position such as shown in FIG. 26 wherein pipes 47 and 50 are located within elongated slot 113 and tab 111 is looped about pipes 47 and 50. The second step is shown in FIG. 27 wherein the adsorbent containers 101 and 101' are passed through the space between pipes 47 and 50, as depicted by arrow 122 so that the adsorbent containers 100 and 101 will assume the position shown in FIG. 27. The third step is shown in FIG. 28 wherein tab 111 is pulled downwardly in the direction of arrow 123. The next step is shown in FIG. 29 wherein the adsorbent unit 100 is doubled over about its central portion 115 so that the adsorbent units 101 and 101' face each other and thereafter tab 111' is placed in position wherein the filter housing 53 can be passed through slot 113' thereof and the return bend 49 can be passed through elongated slot 113' so that tab 111' is looped about spaced pipes 47 and 50. The next step is to move tabs 111 and 111' upwardly over spaced pipes 47 and 50 while maintaining the filter housing 53 in alignment with aperture 120 in central portion 115. The last step in installing the adsorbent unit 100 is shown in FIG. 31 wherein the adsorbent unit 100 is moved upwardly so that filter housing 53 passes through aperture 120 in central container-joining portion 115. Thus, it can be seen that the central portion and the outer ends, as depicted by tabs 111 and 111', are both positively secured to the spaced pipes 47 and 50 and to the return bend 49.

Adsorbent unit 100 may also be installed on U-shaped pipe 40 by overlapping tabs 111 and 111' after the unit is bent around central portion 115 with the less convex sides 104 and 104' facing each other. The return bend 49 is thereafter passed through overlapped slots 113 and 113', and the tabs 111 and 111' are pushed up onto pipes 47 and 50 and the filter housing 53 is threaded through aperture 120 to complete the installation. Also, the adsorbent unit 100 can be mounted on a U-shaped pipe 89 (FIG. 19A) by merely changing the shape of aperture 120 to a shape such as aperture 85 of FIG. 17.

In FIGS. 32 and 33 another double container adsorbent unit 130 is shown which is fabricated of porous polyester sides which are secured to each other by fused seams. Adsorbent unit 130 is symmetrical about vertical centerline 131 and therefore only one half will be described and parts thereof will be designated by unprimed numerals. Mirror-image counterparts on the opposite side will be designated by primed numerals.

Adsorbent unit 130 includes a container 132 having a pronounced convex side 133 and a less pronounced convex side 134. Container 132 is defined by fused seams 135, 137, 139 and 140. A tab 141 extends outwardly from container 132, and it is defined by fused seam 142 which merges into fused seam 135. An aperture 143 is located in tab 141, and it is defined by a fused seam 144. A central portion 145 joins containers 132 and 132', and it is defined by fused seams 139, 139', 147 and 149 which define its outer edges. Fused seam 147 merges into fused seams 132 and 132'. Fused seam 149 merges into fused seams 140 and 140'. An elongated slot 150 is located in central portion 145, and it is defined by fused seam 151. Central portion 145 is essentially a tab because it attaches containers 132 and 132' relative to the U-shaped pipe.

The adsorbent unit 130 is mounted on spaced pipes, such as 47 and 50 of the preceding figures, by passing the return bend 49 and the spaced pipes 47 and 50 through elongated slot 150 in central portion 149 so that central portion 145 is looped about pipes 47 and 50. The central portion is thereafter moved up onto pipes 47 and 50 with preferably the least convex sides 134 and 134' of adsorbent containers 132 and 132' facing the pipes 47 and 50. Thereafter, the filter housing 53 is passed through apertures 143 and 143' in tabs 141 and 141', respectively, to thereby fasten the adsorbent unit 130 securely onto the U-bend pipe 45.

It is to be noted that the lengths of elongated slots 113 and 113' of FIG. 24 and the length of elongated slot 150 of FIG. 32 all approximate the widths of containers 132–132' and containers 101–101', respectively, as defined above relative to elongated slot 25 of FIGS. 1 and 2.

In FIG. 34 an alternate embodiment of a fastening tab construction 160 is shown which may be substituted for any of the apertured tabs such as 15 of FIG. 1 and 141–141' of FIG. 32 shown in the preceding adsorbent unit embodiments. In this respect, the adsorbent unit X, which may represent any adsorbent unit of any of the preceding embodiments and which has fused seams 161, 162 and 163, also has a fused rigid hook member 160 which extends outwardly from fused seam 164 and is integral therewith. The hook member 160 where applicable, can be hooked around a filter housing such as 53 shown in the preceding figures. In this respect, the concave opening 165 may be hooked around the portion of filter housing 53 which is immediately adjacent to the return bend 49.

While preferred embodiments of the present invention have been disclosed, it will be appreciated that the present invention is not limited thereto but may be otherwise embodied within the scope of the following claims.

What is claimed is:

1. An adsorbent unit comprising a porous adsorbent container having a width, adsorbent in said container, a tab extending outwardly from said container, and an elongated slot in said tab extending in the direction of said width of said container and said slot having a length which approximates said width of said container.

2. An adsorbent unit comprising first and second porous containers, a central joining-portion joining first ends of said first and second containers in end-to-end relationship, first and second tabs on second ends of said first and second containers, respectively, first and second elongated slots in said first and second tabs, respectively, extending in the direction of the widths of said first and second containers, and said first and second slots having lengths which approximate the widths of said first and second containers.

3. An adsorbent unit as set forth in claim 2 including an aperture in said central joining portion.

4. An adsorbent unit comprising first and second porous containers having widths, adsorbent in said first and second containers, a central joining-portion joining ends of said first and second containers in end-to-end relationship, and an elongated slot in said central joining portion extending in the direction of said widths of said first and second containers and having a length which approximates the widths of said first and second containers.

5. An adsorbent unit as set forth in claim 4 including first and second tabs on second ends of said first and second containers, respectively.

6. An adsorbent unit as set forth in claim 5 including first and second apertures in said first and second tabs, respectively.

7. An adsorbent unit comprising a porous adsorbent container having a width, adsorbent in said container, a tab extending outwardly from said container, an elongated slot in said tab extending in the direction of said width of said container and said slot having a length which approximates said width of said container, and means on said tab for securing said tab to the return bend of an U-shaped pipe.

8. An adsorbent unit as set forth in claim 7 wherein said means on said tab is for securing said tab to a filter housing on said return bend.

9. An adsorbent unit comprising at least one porous container having a width, adsorbent in said at least one container, an end portion on said at least one container, a tab at said at least one end portion, and an elongated slot in said tab extending in the direction of said width and said slot having a length which approximates said width of said container.

10. An adsorbent unit as set forth in claim 9 including a second end portion on said at least one container, a second tab on said second end portion, and means on said second tab for securing said second tab relative to a return bend of an U-shaped pipe.

11. An adsorbent unit as set forth in claim 10 wherein said means is an aperture.

12. An adsorbent unit as set forth in claim 10 including a second porous container having a second width secured to said second tab on the opposite side thereof from said at least one container, and adsorbent in said second container.

13. An adsorbent unit as set forth in claim 9 including a second porous container secured to said tab, and adsorbent in said second porous container.

14. An adsorbent unit as set forth in claim 13 including a second tab on at least one of said container and said second container.

15. An adsorbent unit comprising a porous adsorbent container having an end portion, adsorbent in said container, and loop means secured at said end portion of said container for looping about at least one pipe of an U-shaped pipe.

16. An adsorbent unit as set forth in claim 15 wherein said loop means are looped about spaced pipes of an U-shaped pipe.

17. In a refrigerant accumulator having a housing with a bottom wall and a side wall and a U-shaped pipe with a return bend adjacent said bottom wall and with first and second pipe portions extending from said return bend along said side wall, and a filter body extending outwardly from said return bend, the improvement of an adsorbent unit comprising a porous adsorbent container having an end portion, adsorbent in said container, and loop means on said end portion of said adsorbent container for looping about at least one of said first and second pipe portions.

18. In a refrigerant accumulator as set forth in claim 17 wherein said loop means are looped both of said first and second pipe portions.

19. An adsorbent unit for mounting relative to a U-bend pipe of a refrigerant accumulator having spaced pipes and a return bend comprising a porous container, adsorbent in said container, an end portion on said container, a tab on said end portion, and an elongated slot in said tab for receiving said spaced pipes.

20. In a refrigerant accumulator having a housing with a side wall and a pipe with first and second pipe portions extending within said side wall, the improvement of an adsorbent unit comprising a porous adsorbent container, adsorbent in said container, a tab extending outwardly from said container, and an elongated slot in said tab mounting said tab on said first and second pipe portions.

21. An adsorbent unit as set forth in claim 7 wherein said means on said tab comprises an aperture which is located between said elongated slot and said container.

* * * * *